US007789382B2

(12) United States Patent
Fukushima

(10) Patent No.: US 7,789,382 B2
(45) Date of Patent: Sep. 7, 2010

(54) BOOKBINDING APPARATUS AND IMAGE FORMING SYSTEM

(75) Inventor: Masahiko Fukushima, Fussa (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 12/057,037

(22) Filed: Mar. 27, 2008

(65) Prior Publication Data

US 2008/0272532 A1 Nov. 6, 2008

(30) Foreign Application Priority Data

May 6, 2007 (JP) ..... 2007-149043

(51) Int. Cl.
*B65H 33/04* (2006.01)
*B65H 39/00* (2006.01)

(52) U.S. Cl. ..... 270/58.07; 270/58.08; 270/58.09; 270/58.11

(58) Field of Classification Search ..... 207/58.07, 207/58.08, 58.09, 58.11
See application file for complete search history.

(56) References Cited

U.S. PATENT DOCUMENTS 5,732,315 A * 3/1998 Inoue et al. ..... 399/317
2005/0238462 A1 * 10/2005 Oota ..... 412/9

* cited by examiner

*Primary Examiner*—Gene Crawford
*Assistant Examiner*—Yolanda Cumbess
(74) *Attorney, Agent, or Firm*—Squire, Sanders & Dempsey L.L.P.

(57) ABSTRACT

Data table specifying the relationship between the number of sheets per one copy of a booklet produced by a bookbinding apparatus B and the working speed of a coating section 60 is selected based on printing speed information of an image forming apparatus A, and the working speed of the coating section 60 is changed in accordance with the number of sheets per one copy of a booklet to be produced.

6 Claims, 7 Drawing Sheets

BOOKBINDING APPARATUS AND IMAGE FORMING SYSTEM

This application is based on Japanese Patent Application No. 2007-149043 filed on Jun. 5, 2007 in Japanese Patent Office, the entire content of which is hereby incorporated by reference.

BACKGROUND OF THE INVENTION

The present invention relates to a bookbinding apparatus and an image forming system which accumulate a plurality of sheets so as to form a bundle of sheets (hereafter, referred simply as a sheet bundle) and join a cover sheet to one side of the sheet bundle so as to produce a booklet.

There have been well known bookbinding apparatuses and image forming systems which bind a plurality of sheets on which images are formed by copying machines, printers and the like into a booklet with a simple way. Here, the outline of a general bookbinding process in these bookbinding apparatuses is explained. First, a plurality of sheets on which images are formed are accumulated and aligned so as to form a sheet bundle. Next, an adhesive, such as a paste, is coated to one side of the sheet bundle. And, a cover sheet is conveyed and stopped at a specified position, and the cover sheet is joined to the adhesive-coated side of the sheet bundle. In this way, the plurality of sheets and the cover sheet are made into one body, whereby a booklet is produced.

In the image forming system described in Patent Document 1, an image forming apparatus and a bookbinding apparatus are connected to each other. Sheets on which images are formed by the image forming apparatus are conveyed from the image forming apparatus to the bookbinding apparatus, and then the bookbinding apparatus produces a booklet promptly.

[Patent documents 1] Japanese Patent Unexamined Publication No. 2004-209746

SUMMARY OF THE INVENTION

According to the present invention, a bookbinding apparatus which accumulates a plurality of sheets to form a sheet bundle and joins a cover sheet to one side of the sheet bundle with an adhesive so as to produce a booklet, comprises:

a coating section to coat an adhesive to the one side of the sheet bundle;

an information obtaining section to obtain printing speed information of an image forming apparatus connected to the bookbinding apparatus;

a selecting section to select at least one data table based on the printing speed information from a plurality of data tables in which the relationship between the number of sheets per one copy of a booklet and the working speed of the coating section is specified, and a control section to control the coating section to change the working speed in accordance with the number of sheets per one copy of a booklet to be produced based on the data table selected by the selecting section.

Moreover, an image forming system which comprises an image forming apparatus to form images on sheets and a bookbinding apparatus to accumulate a plurality of sheets on which images were formed by the image forming apparatus, to form a sheet bundle, to join a cover sheet to one side of the sheet bundle with an adhesive, and to produce a booklet, comprises:

a coating section to coat an adhesive to the one side of the sheet bundle;

a selecting section to select at least one data table based on a printing speed information of the image forming apparatus from a plurality of data tables in which the relationship between a number of sheets per one copy of a booklet and a working speed of the coating section is specified, and a control section to control the coating section to change the working speed in accordance with the number of sheets per one copy of a booklet to be produced based on the data table selected by the selecting section.

DETAILED DESCRIPTION OF THE PREFERRED EMBODIMENT

Figure 1:
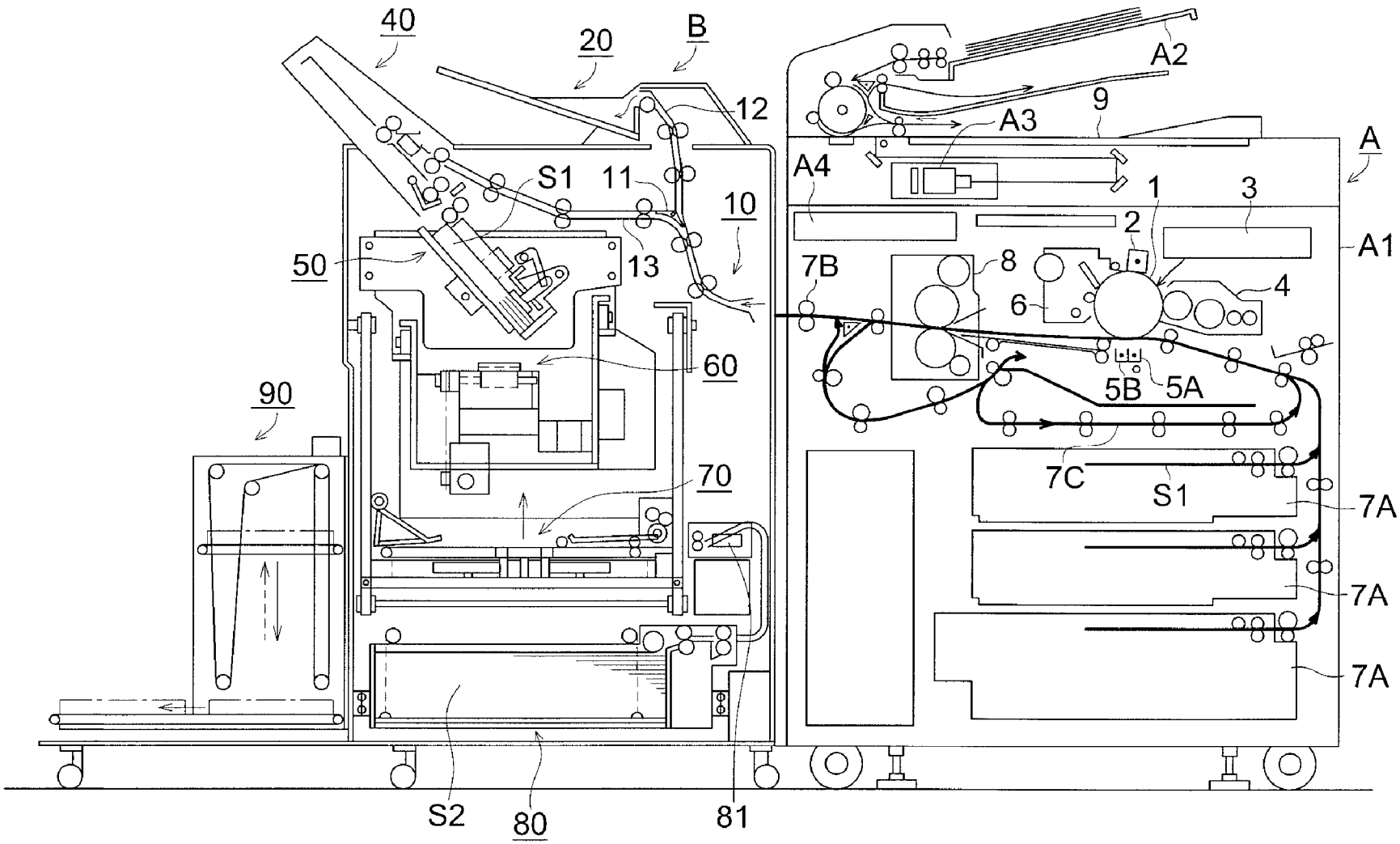
FIG. 1 is a central sectional view of an image forming system.

FIG. 1 is a central sectional view of an image forming system.

The image forming system according to the present invention comprises an image forming apparatus A and a bookbinding apparatus B.

The image forming apparatus A forms an image on a sheet with an electrophotographying technique, and the image forming apparatus A comprises an image forming section A1, a document conveying device A2, an image reading section A3, and a communicating section A4. In the image forming section A1, around a drum-like photoreceptor 1, a charging device 2, a light exposing device 3, a developing device 4, a transferring device 5A, a separating device 5B, and a cleaning device 6 are arranged, and these devices perform respective processes of electrically-charging, exposing, developing, and transferring, whereby a toner image is formed on a sheet S1. The sheet S1 is stored one of three sheet feeding trays 7A, fed out one by one from the sheet feeding trays 7A, and conveyed to the image forming section A1. The sheet S1 onto which a toner image has been transferred passes through a fixing device 8 so that the sheet S1 is subjected to a fixing treatment. After having been subjected to the fixing treatment, the sheet S1 is discharged by a paper ejecting roller 7B to the outside of the image forming apparatus A, or is conveyed to a sheet re-feeding passage 7C.

Incidentally, although the image forming apparatus A in this embodiment forms a monochrome image on a sheet with an electrophotographying technique, the image forming apparatus according to the present invention is not limited to this embodiment, the image forming apparatus A may be a color image forming apparatus as a matter of course, and further, image forming techniques applicable to the present invention include any one of image forming techniques in addition the electrophotographying technique.

The bookbinding apparatus B is an apparatus which bundles a plurality of sheets sent from the image forming apparatus A into a sheet bundle (a bundle of sheets), joins a cover sheet to one end side of the sheet bundle, and covers the sheet bundle with the cover sheet in the shape of the character "U", thereby producing a booklet. The bookbinding apparatus B comprises a sheet reversing section 40, a accumulating section 50, a coating section 60, and a joining section 70 to join a cover sheet to a sheet bundle, and further comprises a conveying section 10, a sheet delivery tray 20, a cover sheet storing section 80, and the booklet discharging section 90. A sheet S1 conveyed from the image forming apparatus A to the bookbinding apparatus B is discharged through a discharging passage 12 to a sheet delivery tray 20 or is conveyed to a sheet reversing section 40 by a switching gate 11 provided in the conveying section 10. When a book is not bound in the bookbinding apparatus B, a sheet S1 is discharged to the sheet delivery tray 20. On the other hand, when a bookbinding process is performed in the bookbinding apparatus B, a sheet S1 is conveyed to the sheet reversing section 40 through a conveying passage 13, and after the sheet S1 is switch-backed in the sheet reversing section 40, the sheet S1 is conveyed to the accumulating section 50. In the accumulating section 50, sheets S1 are accumulated by the set number of sheets. When the sheets S1 have been accumulated by the set number of sheets, the accumulating section 50 rotates so as to hold a bundle of sheets S1 almost in the vertical condition. And then, the underside of the bundle of sheets S1 corresponding to the back side of the bundle of sheets S1 is coated with an adhesive by the coating section 60, and is brought in contact with a cover sheet S2 and pasted with it in the joining section 70, thereby producing a booklet S3. The booklet S3 produced by the process to paste the cover sheet S2 to the bundle of sheets S1 is discharged to a booklet discharging section 90.

Incidentally, although not shown in FIG. 1, there may be also considered another embodiment that sheets to be subjected to a bookbinding process are set on a tray provided on the bookbinding apparatus B and a booklet S3 is produced by the operation of only the bookbinding apparatus B.

Figure 2:
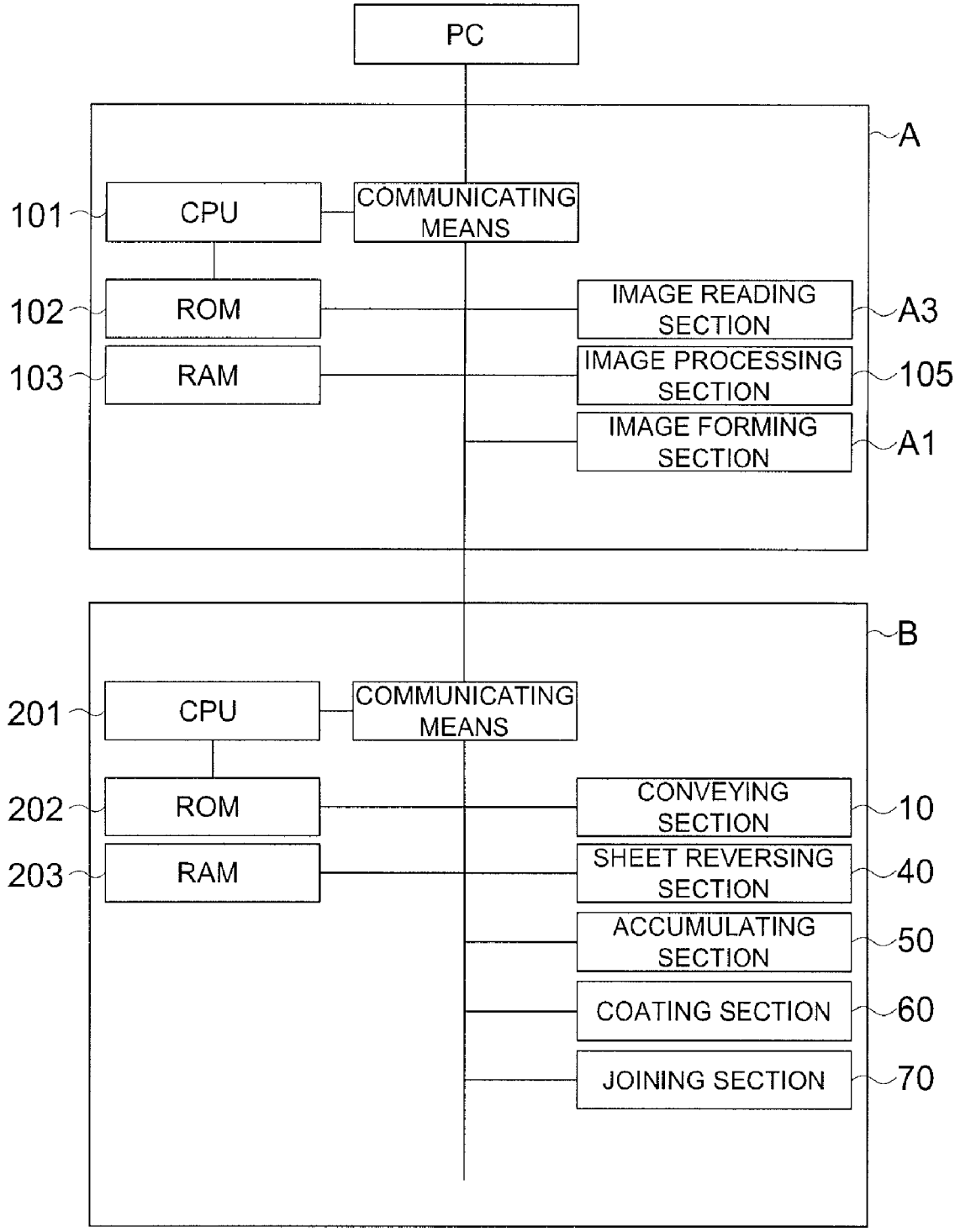
FIG. 2 is a block diagram of a control system in the image forming system.

FIG. 2 is a block diagram of a control system in the image forming system, and shows only typical components here.

A PC which is a terminal such as a personal computer and a bookbinding apparatus B are connected to the image forming apparatus A. However, in the present invention, the PC may not be connected.

A CPU (Central Processing Unit) 101 is to control actions of the whole image forming apparatus A, and is connected to ROM (Read Only Memory) 102, RAM (Random Access Memory) 103 and the like. This CPU 101 reads various control programs stored in the ROM 102, and develops them into RAM 103, and controls the action of each part. Moreover, CPU 101 performs various processes in accordance with the program developed into the RAM 103, and stores the processing results in the RAM 103. And the processing results stored in the RAM 103 are made to save in a predetermined storage destination.

Image data produced by the image reading section A3 and image data transmitted from a PC connected to the image forming apparatus A are applied with image processing by the image processing section 105. The image forming section A1 receives the image data applied with the image processing by the image processing section 105 and forms an image on a sheet.

A CPU 201 in the bookbinding apparatus B is to control actions of the whole bookbinding apparatus B, and performs a bookbinding process with a predetermined timing based on signals transmitted from the image forming apparatus A. The CPU 201 reads various control programs stored in a ROM 202, develops them to RAM 203, and controls actions each part of the coating section 60, the joining section 70 and the like. In the present embodiment, as mentioned later, the working speed to coat an adhesive on a bundle of sheets S1 is changeable in accordance with the printing speed of the image forming apparatus and the number of sheets per one copy of a booklet. Therefore, the CPU 20 controls a motor M3 to shift a coating roller 62 at changeable moving speed and a motor M1 to rotate the coating roller at changeable rotating speed.

The CPU 101 functions as a selecting section to select image forming processes and a control section to control the image forming processes in the image forming apparatus A. The CPU 201 functions as a control section of bookbinding actions, an information obtaining section, and a selecting section in the bookbinding apparatus B, and binds sheets discharged from the image forming apparatus A into a book with a selected booklet structure.

Figure 3:
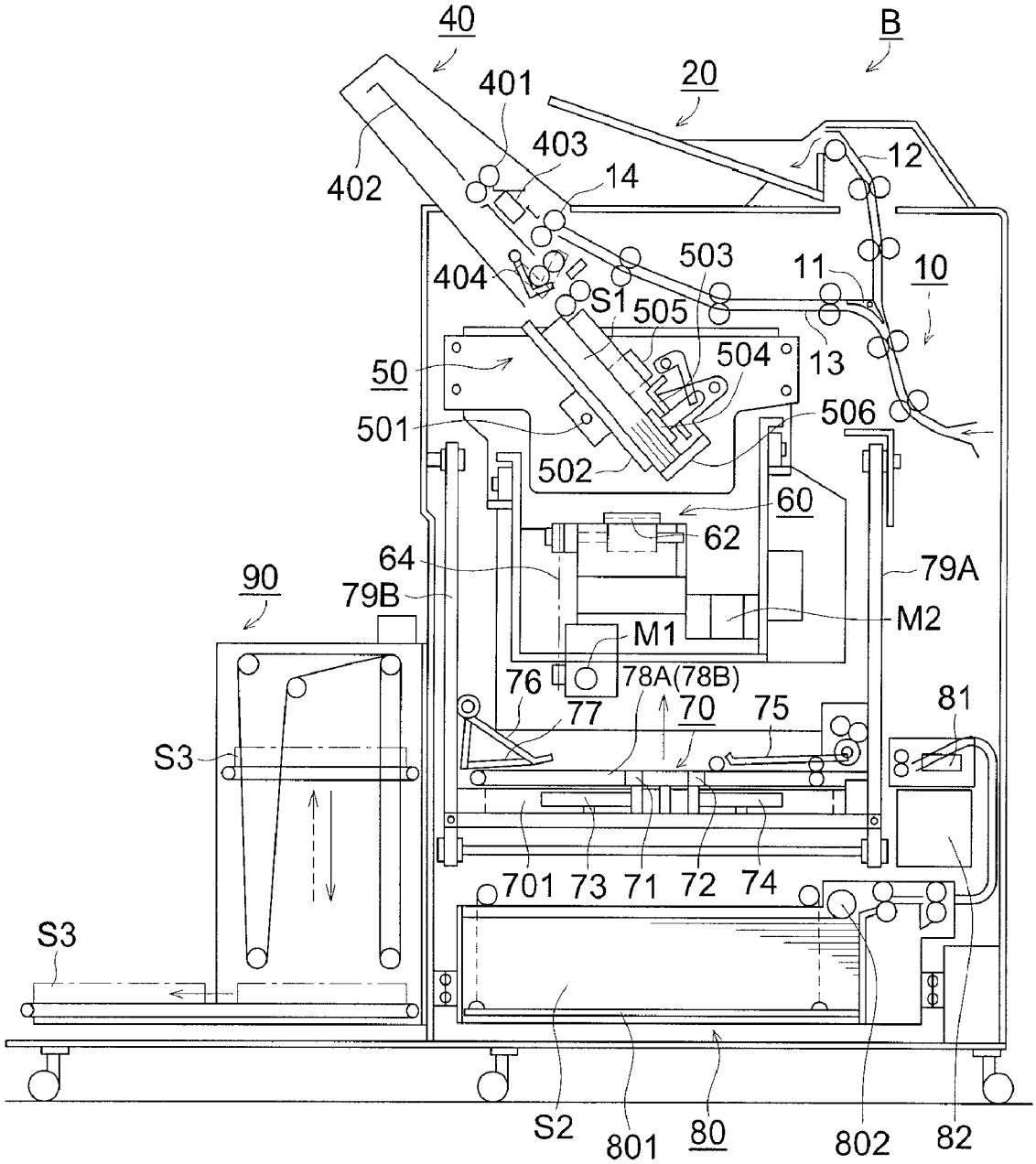
FIG. 3 is a front sectional view of a bookbinding apparatus B.

FIG. 3 is a front sectional view of the bookbinding apparatus B.

A sheet S1 conveyed in a conveying passage 13 is discharged once to a reversing guide 402 through a sheet ejecting roller 14 and a conveying roller 401. The sheet S1 discharged on the reversing guide 402 is aligned in the direction perpendicular to the conveying direction by an aligning member 403, and is temporarily accumulated by the action of a stopper 404. The stopper 404 can act between the position of a solid line and the position of a dotted line. While a preceding bundle of sheets S1 is in the accumulating section 50, the stopper 404 shifts to the position of the dotted line, and accumulates succeeding sheets S1 on the reversing guide 402 temporarily. After the preceding bundle of sheets S1 is taken out from the accumulating section 50, the stopper 404 shifts to the position of the solid line, the sheets S1 accumulated temporarily drop to the accumulating section 50. This accumulating section 50 has a supporting plate 502 and a receiving plate 506, and the sheets S1 are supported in an inclined state by the supporting plate 502 and the receiving plate 506. The sheets S1 currently supported on the inclined state are prevented from floating by a pressing member 504, and are aligned by an aligning plate 505. And the holding plate 503 operates so as to hold a bundle of sheets S1, and on the condition where the bundle of sheets S1 is held, the accumulating section 50 rotates around a shaft 501 as an axis of rotation, thereby changing the bundle of sheets S1 from the inclined state into the vertical state.

Figure 4:
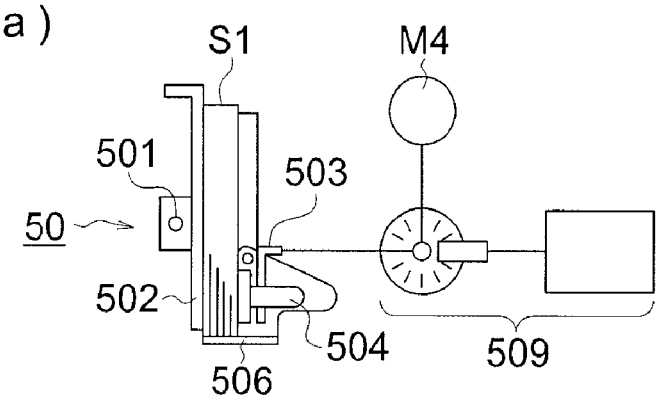
FIG. 4 is an explanatory view showing a process of coating an adhesive to a bundle of sheets S1.
Figure 4:
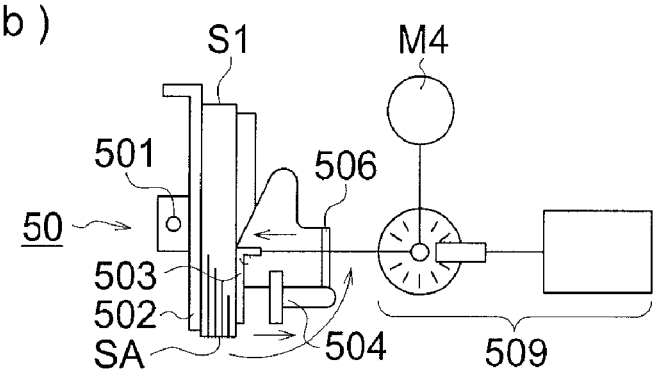
Figure 4:
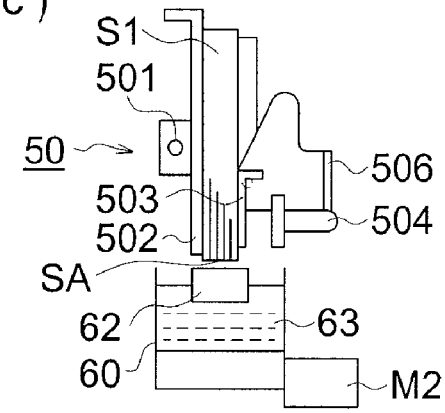
Figure 4:
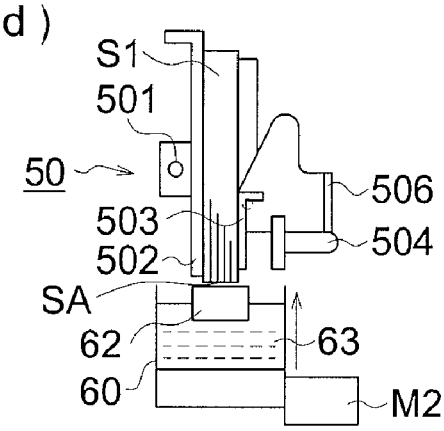

FIG. 4 shows a process of coating an adhesive to the bundle of sheets S1.

When the bundle of sheets S1 becomes the vertical state at the accumulating section 50, a second pinching plate 503 is moved towards a sheet S1 by a motor M4, and when the second pinching plate 503 presses the sheet S1 with a predetermined pressure, an increment of the driving torque of the motor M4 is detected by a driving-torque detecting sensor (not shown), and the movement of the second pinching plate 503 is stopped. The bundle of sheets S1 is firmly held between a first pinching plate 502 and the second pinching plate 503 with such a structure. The movement amount of the second pinching plate 503 is measured by an encoder 509 as information of thickness, and is memorized by memory means, such as RAM.

In the stage where the bundle of sheets S1 is held between the first pinching plate 502 and second pinching plate 503, the receiving plates 506 is rotates by 90 degrees by a driving mechanism (not shown), and is retracted as shown in FIG. 4(*b*). In the stage where the receiving plate 506 is retracted, the underside surface SA of the bundle of sheets S1 and a coating roller 62 are not brought in contact with each other (refer to FIG. 4(*c*)).

Next, as shown in FIG. 4(*d*), the coating section 60 in which the adhesive 63 is stored moves upward so that the coating roller 62 comes in contact via adhesive 63 with the underside surface SA being the back side of the bundle of sheets S1, and when the coating section 60 moves along the underside surface SA of the bundle of sheets S1, the adhesive 63 is coated onto the underside surface SA of the bundle of sheets S1.

Incidentally, as mentioned above, although the embodiment is explained by the use of the roller as a means for coating an adhesive, as long as the intentions of the present invention are not disturbed, a belt and a brush, for example, may also be used here in place of the roller. However, the roller is desirable as a coating member, because the roller is advantageous at the point to supply a melt adhesion agent uniformly to a sheet end with the coating ability for an adhesive and the easiness in conducting heat to make an adhesive into a fully melted condition before being coated.

The coating action of the coating section 60 for the adhesive 63 is explained with reference to FIG. 5.

The coating section 60 comprises a coating roller 62 to coat an adhesive 63 to a sheet bundle, the adhesive 63, an adhesive storing section 64 to store the adhesive 63, and a heater (not shown) to melt an adhesive in a solid state. The adhesive 63 is stored in an adhesive container 66 in a solid state, and when it is detected by a detecting section (not shown) that the remaining quantity of the adhesive 63 in the coating section 60 is little, a movable member 65 moves and the adhesive 63 is supplied to the coating section 60 from the adhesive container 66 in a solid state. And the adhesive 63 is warmed by a heater (not shown) in the coating section 60, and the adhesive in a solid state is melted in the coating section 60.

Figure 5:
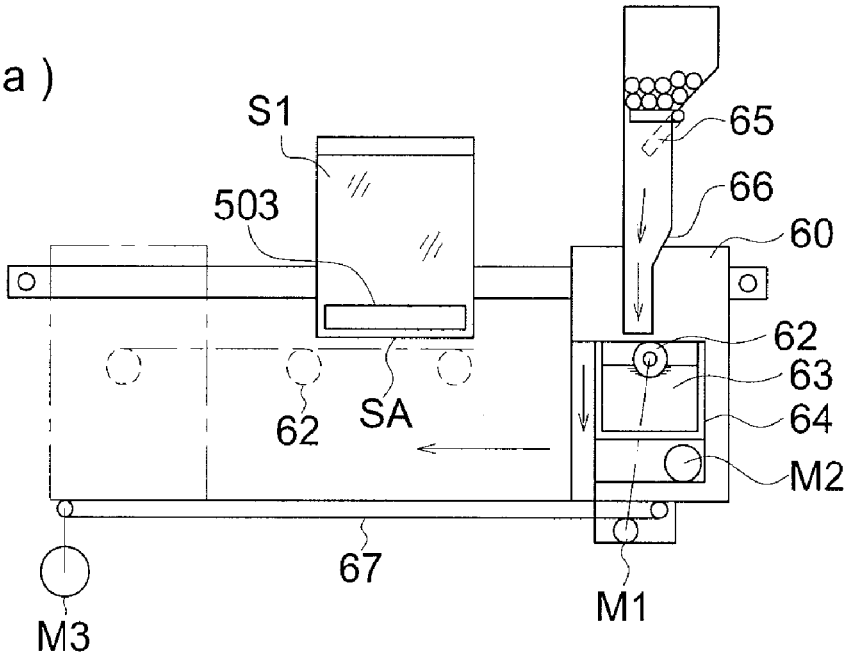
FIG. 5 is an explanatory view showing the coating actions of a coating section 60 for an adhesive 63.
Figure 5:
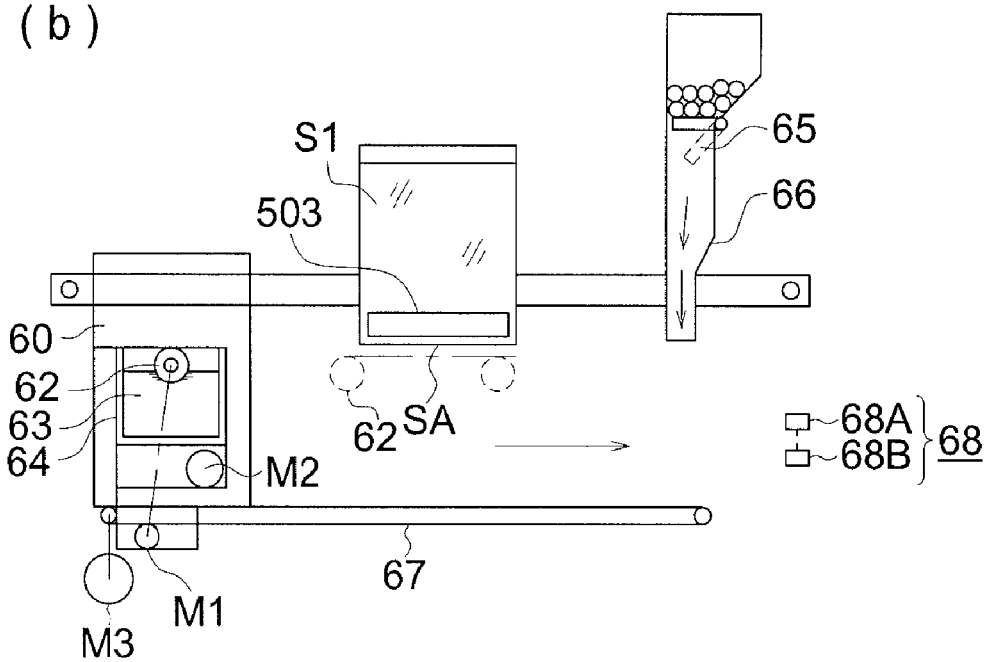

In the starting phase of a bookbinding process, the coating section 60 is in the right end position which is an initial position as shown in FIG. 5(*a*). This right end position corresponds to a back side in the bookbinding apparatus B, i.e., the back side of the sheet of FIG. 1. A position detecting sensor 68 structured with a light emitting element 68A and a light receiving element 68B is provided in the right end position. When the position detecting sensor 68 detects the a part of the coating section 60 locates between the light emitting element 68A and the light receiving element 68B, the coating section 60 is judged as existing in an initial position. When a bookbinding process is started, the coating section 60 moves from the right end position to a left end position (a direction toward the front side of the bookbinding apparatus B). This movement of the coating section 60 is performed by the action of a belt 67 driven by a motor M3. While the coating section 60 moves to the left end position, the coating roller 62 is separated from the underside surface SA of the bundle of sheets S1. And in the stage of FIG. 5(*b*) where the coating section 60 moves from a left end position towards the right end position by the driving of the belt 67, the coating roller 62 is shifted upward by the driving of a motor M2 and is brought in contact with the underside surface SA of the bundle of sheets S1, thereby coating an adhesive 63. The coating roller 62 moves along with a locus as shown with a broken line in FIGS. 5(*a*) and 5(*b*) by a motor M3, and further the coating roller 62 coats an adhesive to underside surface SA of the sheet bundle while being rotated by a motor M1.

Figure 6:
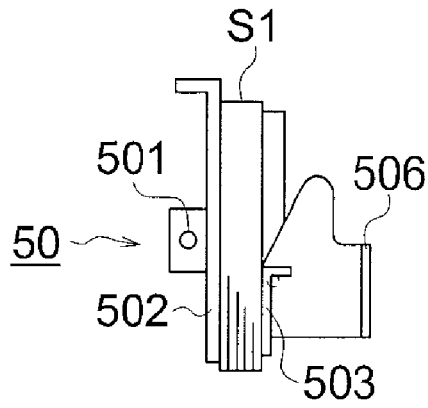
FIG. 6 is an explanatory view showing a joining process for a cover sheet S2.
Figure 6:
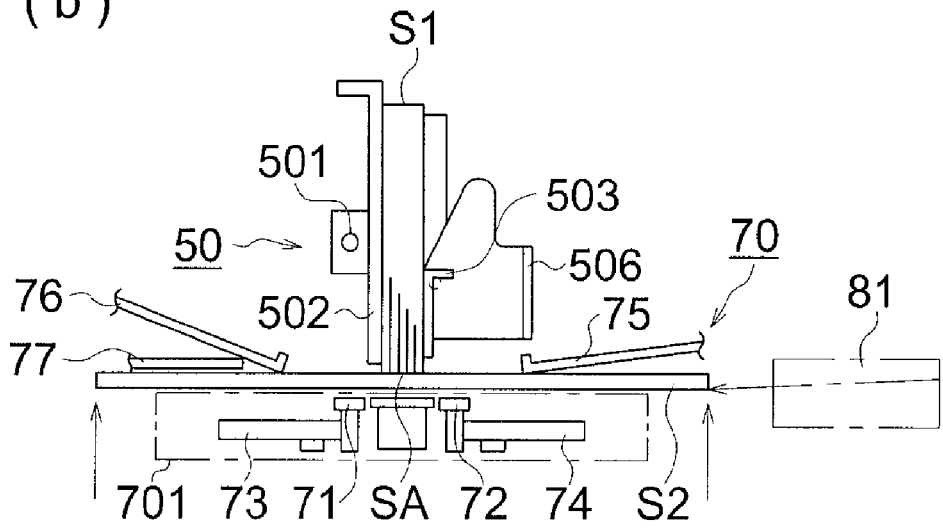
Figure 6:
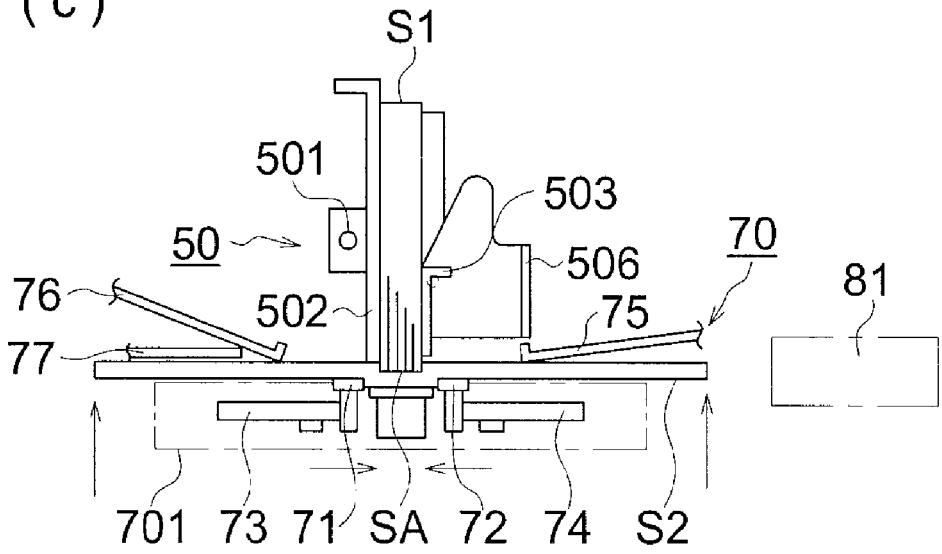

FIG. 6 shows a joining process of a cover sheet S2.

As shown in FIG. 3, a cover sheet S2 is stored in a sheet feeding tray 801 of a cover sheet storing section 80 provided at a lower part of the bookbinding apparatus B, and is fed out by a delivery roller 802. The fed-out cover sheet S2 is cut out into a suitable length as a cover sheet by a cutter 81, and is placed in a horizontal condition on a cover sheet supporting section 701. The cover sheet supporting section 701 shown with a chained line in FIG. 6 is structured with plural members of pressing members 71 and 72 and cams 73 and 74 to drive the pressing members 71 and 72 and the like. In this connection, a cutter 81 cuts out the cover sheet S2 with a prescribed length based on the size information of the sheet S1 and the information about the thickness of the bundle of sheets S1.

FIG. 6(*a*) shows the condition that the coating of the adhesive 63 has been completed. In the state of FIG. 6(*a*), the cover sheet supporting section 701 is supporting a cover sheet S2 at a location of a lower part which is distant from the underside surface of the bundle of sheets S1.

Next, the cover sheet supporting section 701 shifts upward by being driven by belts 79A and 79B (refer to FIG. 3), and becomes to the condition shown in FIG. 6(*b*) where the cover sheet S2 comes in contact with the underside surface SA, i.e., the adhesive-coated side surface, of the bundle of sheets S1. Besides, cover sheet pressing members 75, 76, and 77 shift upward or downward together with the cover sheet supporting section 701. Therefore, as shown in FIG. 6(*b*), when the cover sheet supporting section 701 shifts upward, the cover sheet pressing members 75, 76, and 77 are pressing down the cover sheet S2 from above so as to make the cover sheet S2 in the flat-surface condition.

The cover sheet supporting section 701 shifts upward several millimeters further from the position sown in FIG. 6(*b*). This position having shifted upward several millimeters is the position shown in FIG. 6(*c*). Then, the pressing members 71 and 72 press the cover sheet S2 from right and left so as to make a corner at the boundary between an obverse cover and a spine cover and a corner at the boundary between a reverse cover and the spine cover, whereby the cover sheet S2 is brought in close contact with the bundle of sheets S1 so as to form a booklet S3.

Returning now to FIG. 3, in the configuration of the bookbinding apparatus B, when the accumulating section 50 accommodates a preceding bundle of sheets S1, a succeeding bundle of sheets S1 is temporarily accumulated by the reversing guide 402. From the view points of the productivity of a booklet S3, it is preferable that the accumulating section 50 becomes the condition where the accumulating section 50 can receive succeeding sheets S1 before the reversing guide 402 accumulates a succeeding bundle of sheets S1 corresponding to one copy of the booklet S3.

However, there may be possibilities that various types of image forming apparatus A such as high-speed image forming apparatus may be connected to the bookbinding apparatus B, and also the number of sheets per one copy of booklet is variable to a large extent. Therefore, it may be considered that before the accumulating section 50 becomes the condition where the accumulating section 50 can receive succeeding sheets S1, the reversing guide 402 has accumulated a succeeding bundle of sheets S1 corresponding to one copy of a booklet S3, if a printing speed of the image forming apparatus A is high or the number of sheets per one copy of booklet is few.

Then, in the bookbinding apparatus B of the present invention, the rate of a coating action to coat an adhesive 63 to a bundle of sheets S1 structured to be changeable changed in accordance with the printing speed of the image forming apparatus A, or the number of sheets per one copy of a booklet, whereby the accumulating section 50 can be made the condition where the accumulating section 50 can receive succeeding sheets S1 before the reversing guide 402 accumulates a succeeding bundle of sheets S1 corresponding to one copy of the booklet S3. This technique will be explained in detail with reference to a flowchart shown in FIG. 7.

Figure 7:
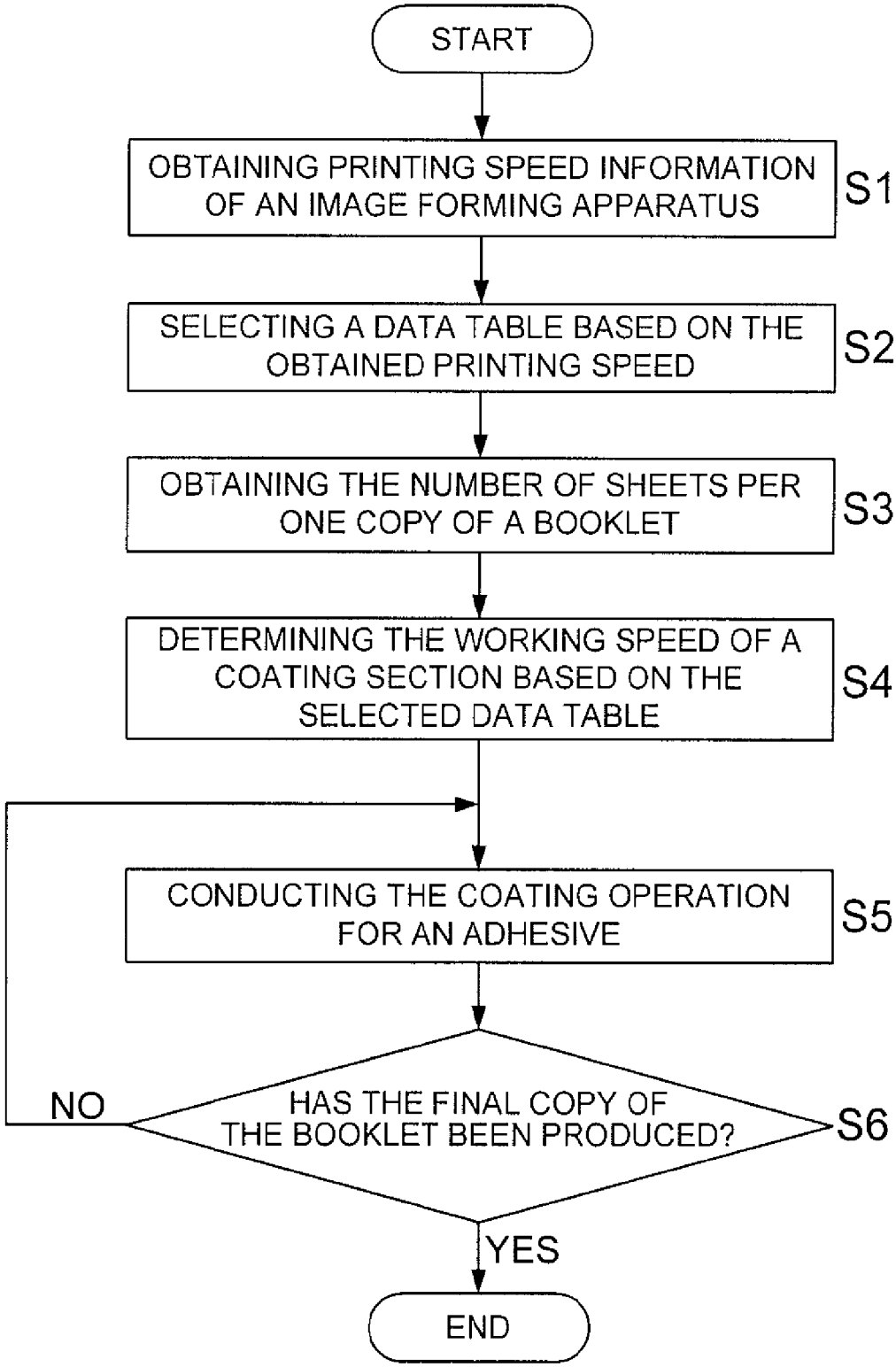
FIG. 7 is a flowchart with regard to changing the working speed of the coating section.

FIG. 7 is a flowchart with regard to a change of an working speed in a coating section.

The CPU 201 of the bookbinding apparatus B controls a series of operations shown in FIG. 7.

Firstly, the bookbinding apparatus B obtains printing-speed information from the image forming apparatus A (Step S1). As an example of the printing-speed information, it is information about the number of sheets to be printed per a predetermined period of time, such as "40 cpm". Alternatively, the printing-speed information may be a conveying speed for the printed sheet in the image forming apparatus A.

If the printing-speed information is obtained at Step S1, a data table is selected based on the printing-speed information (Step S2). Here, a plurality of data tables is memorized in the ROM 202 corresponding to a plurality of the printing-speed information. The bookbinding apparatus B select one data table from a plurality of the data tables based on the printing-speed information of the image forming apparatus A. A data table to be selected at Step S2 specifies the relationship between the number of sheets per one copy of a booklet and the working speed of the coating section 60. One example of a data table is shown in Table 1. Incidentally, the data table in the present invention is not limited to the data table shown in Table 1. As long as the relationship between the number of sheets per one copy of a booklet and the working speed of the coating section 60 is specified, any kind of data table may be used.

TABLE 1

| The number of sheets per one copy of a booklet | The working speed of the coating section (mm/s) |
|---|---|
| 10 or less sheets | 2.5X |
| 11 to 20 sheets | 2.0X |
| 21 to 30 sheets | 1.5X |
| 31 or more sheets | X |

The working speed of the coating section 60 is the moving speed of the coating section 60 or the coating roller 62 to a bundle of sheets S1. Taking one example in FIG. 5, the working speed is the moving speed of the coating section 60 or the coating roller 62 in the left-to-right direction (the arrowed direction shown in FIG. 5). When a numeric value of the working speed of the coating section 60 becomes higher, the coating action for an adhesive 63 becomes quicker.

In the example shown in Table 1, the working speed of the coating section 60 is set as four steps.

According to the selection of data table, when the number of sheets per one copy of booklet is 31 or more sheets, the working speed of the coating section 60 is made an ordinary speed of X mm/s in order to establish the condition where the accumulating section 50 can receive a succeeding bundle of sheets S1 before the reversing guide 402 accumulates all sheets S1 corresponding to one copy of the booklet S3.

However, if the number of sheets per one copy of a booklet is 30 or less sheets, the number of sheets per one copy of booklet becomes few relatively to the printing speed of the image forming apparatus A. Therefore, if the ordinary speed of X mm/s is maintained as the working speed of the coating section 60, before the accumulating section 50 becomes the condition where the accumulating section 50 can receive a succeeding bundle of sheets S1, the reversing guide 402 has accumulated all sheets S1 corresponding to one copy of the booklet S3.

Then, when the number of sheets per one copy of booklet is 21 to 30 sheets as shown in Table 1, the working speed of the coating section 60 is set to 1.5×, that is, 1.5 times of the ordinary speed of X mm/s, thereby making the working speed of the coating section 60 faster. Likewise, when the number of sheets per one copy of booklet is 11 to 20 sheets, the working speed of the coating section 60 is set to 2.0×, and when the number of sheets per one copy of booklet is ten or less sheets, the working speed of the coating section 60 is set to 2.5×. In this way, as the number of sheets per one copy of booklet is decreasing, the working speed of the coating section 60 is made faster. As a result, the accumulating section 50 can be made on the condition where the accumulating section 50 can receive a succeeding bundle of sheets S1, before the reversing guide 402 has accumulated all sheets S1 corresponding to one copy of the booklet S3.

Incidentally, Table 1 shows only one data table corresponding to a certain printing speed. However, as mentioned above, a plurality of data tables are stored in the ROM 202. For example, in the case where image are formed with a printing speed faster than the printing speed in Table 1, a time necessary for accumulating all sheets of one copy of a booklet in the reversing guide 402 becomes shorter than that in the case where image are formed with the printing speed in Table 1. Therefore, in this faster printing speed, another data table is selected such that the working speed of the coating section 60 corresponding to the number of sheets per one copy of a booklet is increased than that in Table 1 or the number of sheets per one copy of a booklet corresponding to the working speed of the coating section is decreased than that in Table 1. In this way, the ROM 202 stores a plurality of data tables corresponding to a plurality of different printing speeds.

Returning now to FIG. 7, the explanation about the flowchart will be continued.

After a data table is selected at Step S2, at Step S3, the operation shifts to operations at the time of actually producing a booklet S3, and the bookbinding apparatus B obtain the information about the number of sheets per one copy of a booklet produced by the image forming system. This information about the number of sheets is obtained based on the attribute information of a print job to be performed by an image forming system. Here, the shifting distance (a thickness of a booklet) of the second holding plate 503 measured by the encoder 509 may used as the number of sheets per one copy of a booklet.

Next, the bookbinding apparatus B determines the working speed of the coating section 60 (the moving speed of the coating roller 62) based on the data table selected at Step S2 (Step S4). Taking the example of Table 1, when the number of sheets in one copy of booklet is 15 sheets, the working speed of the coating section 60 (the moving speed of the coating roller 62) is set to 2.0×, and the coating action for an adhesive 63 is performed more quickly than usual.

On the other hand, when the moving speed of the coating roller 62 is made faster than usual, and if the rotating speed of the coating roller 62 is not changed from ordinary speed, the coated amount of an adhesive 63 decrease. Therefore, when the moving speed of the coating roller 62 is made faster, the rotating speed of the coating roller 63 is also made to increase.

Thus, the coating action for the adhesive in the coating section 60 is performed with the working speed determined at Step S4 (Step S5), and the coating action for the adhesive in Step S5 is continued until the production of the last copy of the booklet is completed.

As explained above, in the bookbinding apparatus B of the present invention, a data table is selected based on the printing-speed information of the image forming apparatus A, and then the working speed of the coating section 60 is changed based on the number of sheets per one copy of a booklet. Therefore, even if any type of image forming apparatus A is connected to the bookbinding apparatus B, before all sheets S1 of one copy of a booklet are accumulated by the reversing guide 402, the accumulating section 50 can be made on the condition where the accumulating section 50 can receive a succeeding bundle of sheets S1. As a result, the productivity of a booklet can be enhanced without stopping the action of image forming apparatus.

Further, in the case where an image forming apparatus A can form both of a color image and a monochromatic image, the printing speed of the color image is different from that of the monochromatic image in many cases. Therefore, in the case where this type of the image forming apparatus A is connected to the bookbinding apparatus B, by selecting a data table in accordance with the printing speed of an image forming mode (color image or monochromatic image), the productivity of a booklet can be improved more.

Incidentally, the present invention is not limited to the above embodiments, and even if there may be any modification and addition in the range which does not deviate from the concept of the present invention, such modification and addition are included in the scope of the present invention.

Although the image forming system shown in FIG. 1 represents the embodiment in which the image forming apparatus A and the bookbinding apparatus B are connected, for example, even if the image forming system is structured such that the image forming apparatus A and the bookbinding apparatus B are united into one apparatus, it has the same effects.

Further, the present embodiment is structured such that a plurality of data tables are stored in the ROM 202 in the bookbinding apparatus B and one data table is selected based on the printing speed information from the plurality of data tables stored in the ROM 202. However, the plurality of data tables may not be stored in the ROM 202 in the bookbinding apparatus B, for example, the image forming system may be structured such that a server storing the plurality of data tables may be connected additionally to the image forming system. In this case, when the bookbinding apparatus B obtains printing speed information, the bookbinding apparatus B accesses the server and selects one data table from the plurality of data tables stored in the server.

What is claimed is:

1. A bookbinding apparatus which accumulates a plurality of sheets discharged from an image forming apparatus, to form a sheet bundle and joins a cover sheet to one side of the sheet bundle with an adhesive so as to produce a booklet, comprising:

an applying section to apply the adhesive to the one side of the sheet bundle;

a driving section to move the applying section linearly in a direction along the one side of the sheet bundle from one edge of the sheet bundle to the other edge thereof; and a control section to control the driving section to move the applying section at a moving speed of the linear movement in the direction in accordance with the number of sheets per one booklet to be produced and printing speed information of the image forming apparatus connected to the bookbinding apparatus.

2. The bookbinding apparatus described in claim 1, wherein the applying section includes an applying roller, and the applying section applies the adhesive to the one side of the sheet bundle with the applying roller being rotated.

3. The bookbinding apparatus described in claim 2, wherein when the control section controls the driving section to increase the moving speed of the applying section, the control section controls the applying section to increase the rotating speed of the applying roller.

4. An image forming system which comprises an image forming apparatus to form images on sheets and a bookbinding apparatus to accumulate a plurality of sheets on which images were formed by the image forming apparatus, to form a sheet bundle, to join a cover sheet to one side of the sheet bundle with an adhesive, and to produce a booklet, comprising:

an applying section to apply the adhesive to the one side of the sheet bundle;

a driving section to move the applying section linearly in a direction along the one side of the sheet bundle from one edge of the sheet bundle to the other edge thereof;

a selecting section to select at least one data table from a plurality of data tables based on a printing speed information of the image forming apparatus, each data table specifying the relationship between a number of sheets per one booklet and a moving speed of the applying coating section in the direction, and a control section to control the driving section to move the applying section at the moving speed of the linear movement in the direction in accordance with the number of sheets per one booklet to be produced based on the data table selected by the selecting section.

5. The image forming system described in claim 4, wherein the applying section includes an applying roller, the applying section applies the adhesive to the one side of the sheet bundle with the applying roller being rotated.

6. The image forming system described in claim 5, wherein when the control section controls the driving section to increase the moving speed of the applying section, the control section controls the applying section to increase the rotating speed of the applying roller.

* * * * *